United States Patent [19]

Graham

[11] 4,043,122

[45] Aug. 23, 1977

[54] FLUID CAM ASSEMBLY

[75] Inventor: James T. Graham, Birmingham, Mich.

[73] Assignee: Android International, Inc., Birmingham, Mich.

[21] Appl. No.: 673,289

[22] Filed: Apr. 2, 1976

[51] Int. Cl.[2] ..... F15B 13/09

[52] U.S. Cl. ..... 60/375; 60/477; 60/486; 91/420

[58] Field of Search ..... 60/375, 378, 453, 456, 60/477, 486; 91/35, 36, 41, 420; 417/216

[56] References Cited

U.S. PATENT DOCUMENTS

| | | | |
|---|---|---|---|
| 2,328,980 | 9/1943 | Herman et al. | 91/420 |
| 2,573,943 | 11/1951 | Ziskal | 91/420 X |
| 2,938,347 | 5/1960 | Sturgis | 60/456 |

*Primary Examiner*—Edgar W. Geoghegan
*Attorney, Agent, or Firm*—Whittemore, Hulbert & Belknap

[57] ABSTRACT

Apparatus for imparting reciprocating motion to a double-acting hydraulic piston and cylinder motor assembly. Hydraulic fluid is supplied through pressure lines alternately to opposite ends of the cylinder by two pumps. The pumps are operated so that one is on its pressure stroke while the other is on its suction stroke. The valving is such that fluid flowing out of the cylinder is discharged to an unpressured reservoir and fluid flowing into the pumps on their suction strokes is drawn from the same reservoir.

17 Claims, 10 Drawing Figures

FLUID CAM ASSEMBLY

BACKGROUND AND SUMMARY OF THE INVENTION

This invention relates to hydraulic controlling and driving apparatus adapted to operate movable machine members, such for example as machine tools, assembling, gauging and testing machines, material handling mechanisms or other similar manufacturing equipment.

In accordance with preferred embodiments of the invention, cam driven hydraulic piston pumps are employed to drive hydraulic cylinders which operate the various machine members.

It has previously been proposed to drive machine members by cam driven hydraulic piston pumps such as those disclosed in the patents to Arter U.S. Pat. No. 2,092,721 and Thompson U.S. Pat. Nos. 2,915,855 and 3,071,929. These prior systems lacked dependability and therefore have not had widespread use in industry. Such previous systems worked in a manner similar to the operation of hydraulic tappets used in automotive engines. Such systems employed a single closed fluid column between the cam shaft piston pump and the driven cylinder. Both the pump and the cylinder were single acting. It was necessary to maintain the fluid column in compression and to provide a return force, and for that purpose Arter used a spring. In the Thompson patents, fluid under pressure from a pressurized reservoir was used. Compressed air provided the necessary force to pressurize the fluid in the reservoir.

In both tha Arter and Thompson patents, the cams were required to overcome the returning forces. Thus the cam work force was always larger than the return force. There was also no assurance that the piston would follow the cam if rapid return movement was required. The fluid could cavitate, outside air could leak into the system or air dissolved in the fluid could come out of the solution. The resulting voids in the fluid column caused loss of positive control by the cams. In addition, these single acting closed column systems were limited in their ability to control overrunning loads. The only force available to retard motion initiated by the cam was the limited power of the spring or the compressed air.

The present invention is intended to provide an improved hydraulic controlling and driving apparatus and to overcome the shortcomings in the prior art systems referred to above.

In one or more embodiments of the present invention, a two-line system is used neither one of which constitutes a closed column. Two fluid pressure lines lead to opposite ends of a double-acting motor cylinder. Cam operated pumps are provided to deliver pressure fluid alternately to opposite ends of the cylinder through these lines. Each fluid line is controlled by a valve mechanism.

The valve mechanism in each line includes a check valve which prevents fluid from flowing out of the cylinder back to the pump. On the suction strokes of the pumps, fresh fluid is drawn from an unpressurized reservoir. These check valves prevent the cylinder from motorizing the piston pumps under the influence of a following load.

A second valve in each valve mechanism is a discharge valve. It is caused to open by pilot pressure from the opposite valve mechanism to discharge returning fluid from the cylinder to the reservoir. By discharging fluid returning from the cylinder back to the reservoir and drawing fresh fluid from the reservoir during the suction stroke of the pump, entrapped air has a chance to settle out in the reservoir. This eliminates the air entrapment problem common with the enclosed liquid columns of the prior art devices and prevents the effect of slight leaks in the system from becoming cumulative.

The third valve in each valve mechanism is a suction intake valve to refill the piston pump from the reservoir on each intake stroke. This valve is pilot operated by pressure from the other valve mechanism. Accordingly, the problems of entrapped air and cavitation are reduced.

Other objects and features of the invention will become more apparent as this description proceeds, especially when taken in conjunction with the accompanying drawings, wherein.

Referring now more particularly to the drawings and especially to FIG. 4, the hydraulic mechanism 1 there shown will now be described. This Figure represents diagrammatically one of the operating and control mechanisms employed in the structure which is more fully illustrated in FIGS. 1 to 3. Actually FIG. 1 may also be considered as a diagrammatic representation of all of the mechanisms 1–5 in FIGS. 1–3. It is believed that the invention will be more readily comprehended from an initial description of the diagram in FIG. 4.

Figure 4:
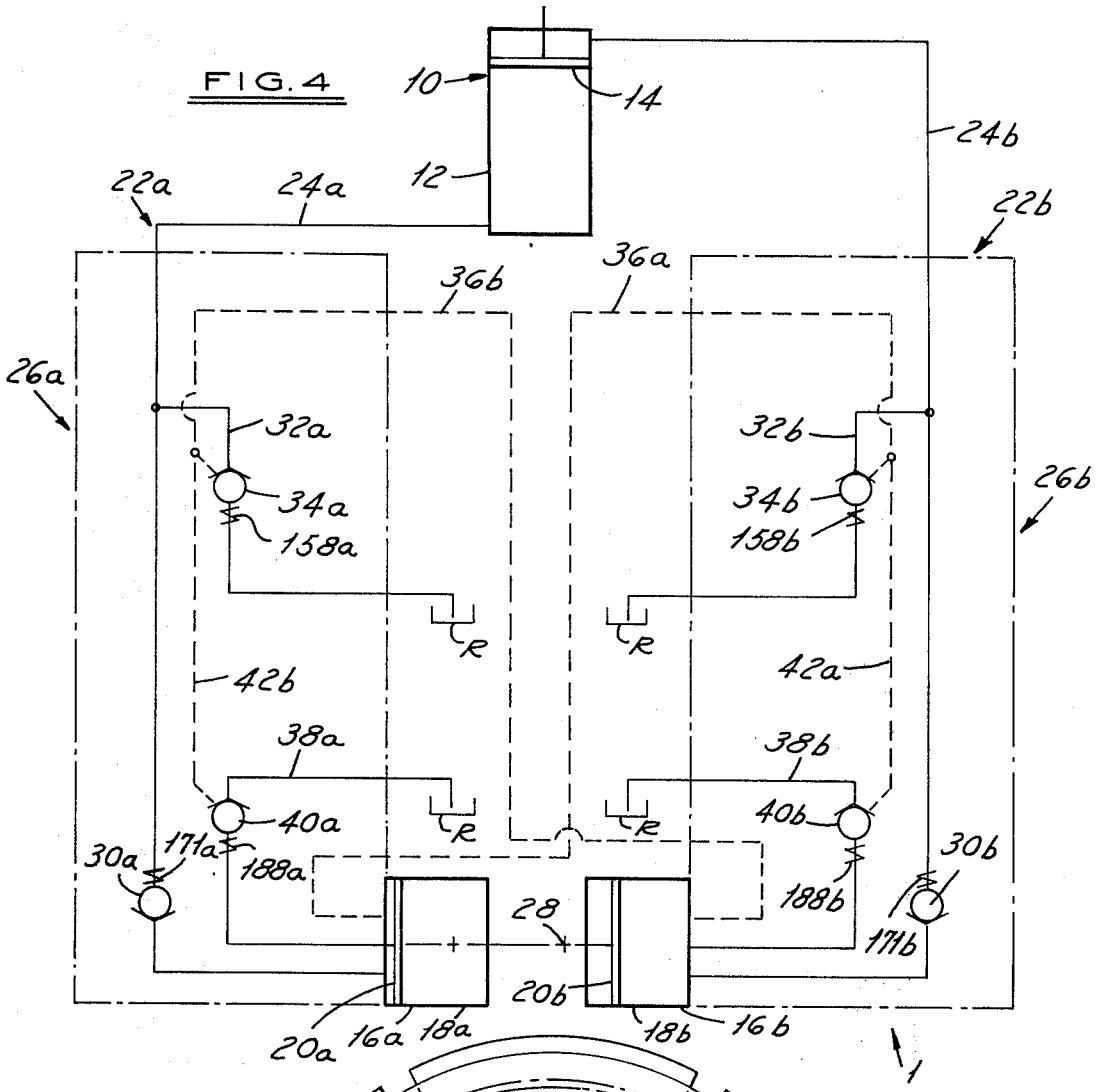
FIG. 4 is a hydraulic diagram of a portion of the device shown in FIGS. 1 and 2.

As seen in FIG. 4, there is a double-acting hydraulic piston cylinder motor assembly 10 composed of a cylinder 12 and piston 14. The piston 14 may be considered as being connected to a mechanical device such, for example, as a machine element on a machine tool which is moved to and fro by the piston. The piston pumps are also illustrated in FIG. 4, one designated **16*a* and the other 16*b*. Pump 16*a* has a cylinder 18*a* and a piston 20*a*. Pump 16*b* has a cylinder 18*b* and a piston 20*b*. Each pump is part of a hydraulic system, one designated 22*a* and the other 22*b*, for controlling the flow of hydraulic fluid to and from opposite ends of the motor cylinder 12. The system 22*a* includes a hydraulic pressure line 24*a* leading from the pump 16*a* to one end of cylinder 12 and system 22*b* includes a hydraulic pressure line 24*b* leading from the pump 16*b* to the opposite end of the cylinder 12. A valve assembly 26*a* is provided for the hydraulic system 22*a* and a valve assembly 26*b* is provided for the hydraulic system 22*b*. These valve assemblies control the flow of hydraulic fluid to and from the pumps and the hydraulic cylinder. The two systems 22a and 22b** are substantially identical and accordingly the parts thereof are designated by the same numerals followed by the letter *a* or *b*.

The pistons 20a and 20b of the two pumps are mechanically linked together by a yoke 28 which constrains them to move as a unit. Thus when one piston is on its pressure stroke the other piston is on its suction stroke and vice versa. These pistons are controlled in their movements by cams which will be more fully described in the detailed description of the apparatus shown in FIGS. 1 to 3 but which are not illustrated in FIG. 4.

The pressure line 24a from pump 16a to the lower end of cylinder 12 has a check valve 30a in valve mechanism 26a which permits flow in a direction from the pump to the cylinder 12 but prevents reverse flow. This valve is normally closed under spring pressure but opens in response to movement of the piston 20a on its pressure stroke to supply hydraulic fluid to the lower end of the cylinder and raise the piston 14. A similar valve 30b in valve mechanism 26b is provided in the pressure line 24b.

A fluid discharge line 32a extends from the pressure line 24a to the unpressurized reservoir R. The valve assembly 26a has a discharge valve 34a in discharge line 32a This valve permits flow of fluid in a direction towards the reservoir but prevents reverse flow. It is normally closed by spring pressure. It is forced open by pilot pressure in the pilot pressure line 36b which leads from the cylinder of the pump 16b of the other system 22b. When the piston of pump 16b is on its pressure stroke, pilot pressure in line 36b is sufficient to open check valve 34a to permit fluid to be discharged from the lower end of the cylinder 12.

A similar discharge line 32b and check valve 34b are provided in the system 22b. Note also the pilot pressure line 36a from the cylinder of pump 16a to the check valve 34b.

A suction intake line 38a extends from the unpressurized reservoir R to the cylinder of pump 16a to allow hydraulic fluid to fill the cylinder when the piston is on its suction stroke. Line 38a is controlled by a check valve 40a in the valve assembly 26a. Check valve 40a permits flow of fluid in a direction to the pump 16a but prevents reverse flow. It is normally held closed by spring pressure. It is opened by fluid pressure in the extension 42b of pilot pressure line 36b when the piston of pump 16b of the other system is on its pressure stroke during which time of course the piston of pump 16a is on its suction stroke.

A similar suction intake line 38b and check valve 40b are provided in the other system 22b. Note also the pilot pressure extension 42a to valve 40b.

In operation, when the piston of pump 16a is on its pressure stroke the piston of pump 16b is on its suction stroke. Hydraulic fluid is supplied under pressure to the lower end of cylinder 12 through pressure line 24a and past check valve 30a to raise piston 14. At the same time, pilot pressure in line 36a opens check valve 34b to permit fluid in the upper end of cylinder 12 to be discharged through discharge line 32b to the reservoir R. Simultaneously pilot pressure in the pilot pressure line extension 42a opens check valve 40b to cause hydraulic fluid to be drawn from the reservoir R into the cylinder of pump 16b.

The action is reversed when the pump 16a is on its suction stroke and pump 16b is on its pressure stroke to move the piston 14 downward.

It will thus be seen that the check valves 30a and 30b prevent fluid from flowing from the cylinder 12 back to the pumps on their suction strokes. When the pumps are on their suction strokes fresh fluid is drawn into the pumps from the unpressurized reservoirs. Accordingly, the check valves 30a prevent the cylinder 12 from motorizing the piston pumps under the influence of a following load.

The valves 34a and 34b as seen are caused to open by pilot pressure from the opposite valve mechanism. It should be understood that when initial motion of the pumps occurs, pressure is generated on both sides of the piston in cylinder 12. This pressure is also transmitted to the valve 34a or 34b, depending on in which direction movement has been initiated, causing that discharge valve to open before piston 14 can move. Assuming pump 16a is on its pressure stroke, the valve 34b will open by pilot pressure. The pressure on the upper or discharge side of the cylinder 12 then drops and movement of the piston 14 can occur. If there should follow a deceleration of the movement of the pump piston 20a on its pressure stroke, then the volume of fluid supplied by that pump is diminished, resulting in a drop in pressure. This drop in pressure is accompanied by a pressure drop in the pilot line 36a permitting discharge valve 34b to close throttling down the discharge of fluid from the cylinder 12 which reduces the velocity of the motion accordingly. This action maintains the fluid pressure on both sides of cylinder 12 at a positive value and minimizes cavitation. By discharging the fluid returning from the cylinder 12 back into the reservoir and drawing fresh fluid from the reservoir during the suction stroke of the pump, entrapped air has a chance to settle out in the reservoir. This eliminates the problem of air entrapment within closed liquid columns of the previous inventions and prevents the effect of slight leaks in the system from becoming cumulative.

The other function of the discharge valves 34a and 34b is to provide overload protection for the system. These valves are held closed by calibrated springs 158a and 158b respectively. When the pressure line to which one of the discharge valves is connected is pressurized and motion is taking place, the spring is strong enough to keep the valve closed against normal working pressure. When the piston 14 is prevented from moving for any reason, a pressure rise above normal results in the discharge valve spring collapses venting the excessive pressure to the reservoir. As soon as the pressure returns to normal the valve closes and normal operation continues.

When the yoke connecting the pump pistons stops moving, pressure in both valve mechanisms drops to zero and both discharge valves are closed. The piston 14 is locked hydraulically and cannot be moved unless sufficient external force is applied to force open the safety overload.

The valves 40a and 40b are pilot operated suction intake valves to refill the piston pump from the reservoir on each intake stroke of the pump. Pilot pressure is used to open the valve to assure complete filling during high speed operation of the system. This also reduces the problems of entrapped air and cavitation in the fluid. The suction valves and discharge valves of each system are connected to the same pilot line so that the two valves work together.

Figure 1:
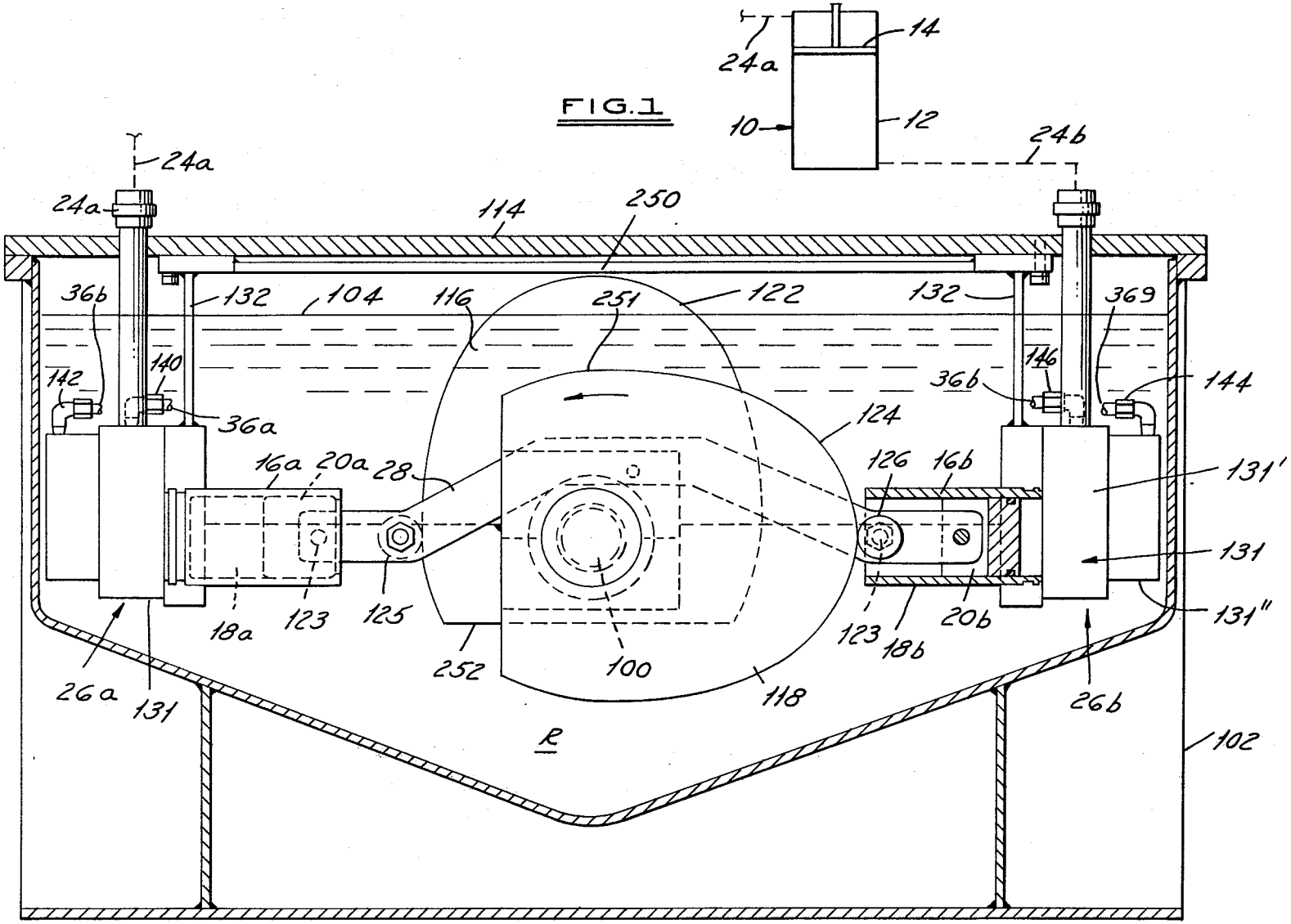
FIG. 1 is an end elevational view with parts in section of apparatus embodying my invention.
Figure 2:
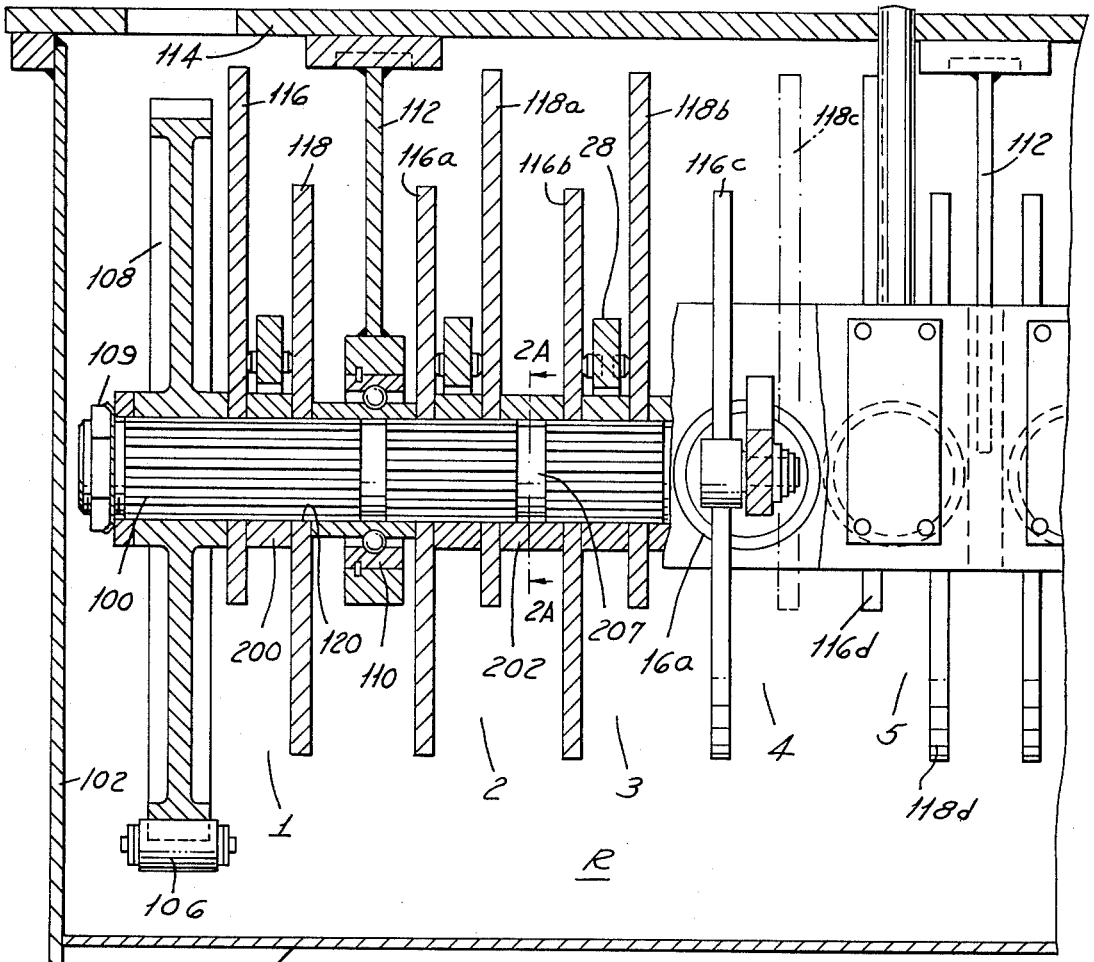
FIG. 2 is a fragmentary view with parts in elevation and parts in section of the apparatus shown in FIG. 1 as viewed from one side thereof.
Figure 3A:
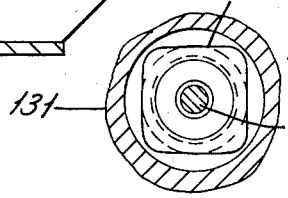
FIG. 3A is a sectional view taken on the line 3A—3A in FIG. 3.
Figure 3:
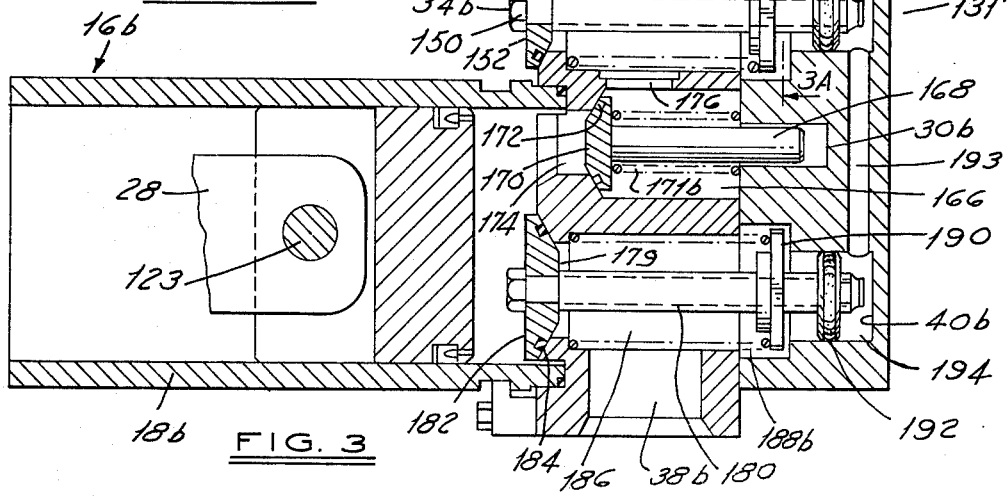
FIG. 3 is an enlarged detailed sectional view of one of the valve bodies.

Referring now to FIGS. 1 to 3 inclusive, there is there shown a plurality of mechanisms 1–5 for hydraulically controlling and driving a number of different devices such as machine tool members, for example. Each mechanism is specifically designed for the control of a different member although driven from the same cam shaft as will be understood from the following description.

The apparatus shown particularly in FIGS. 1 and 2 includes a splined shaft 100 mounted horizontally in a tank 102 providing a reservoir R of a suitable hydraulic fluid such as oil up to the level indicted at 104 to substantially entirely immerse the apparatus. The cam shaft is driven from a suitable source of power not shown by a link chain or other flexible linear member 106 which extends over a sprocket wheel 108 keyed or otherwise secured to one end of the cam shaft and retained by nut 109. The cam shaft is supported for rotation on bearings 110 carried by struts 112 secured to the top cover or lid 114 of the tank. The oil in the reservoir is not pressurized, that is it is under only the pressure of the atmosphere.

The individual mechanisms 1–5 for controlling the various machine elements are disposed side by side along the length of the cam shaft. Since these mechanisms are substantially the same although their cams are individually contoured to perform different movements, only the mechanism 1 will be described in detail. The mechanism 1 includes a pair of cams 116 and 118. These cams are in the form of flat discs having splined openings 120 receiving the cam shaft, the splines providing a positive drive from the shaft to the cams. The peripheral surfaces 122 and 124 of the cams provide lobes which are individually contoured to control the movement of the particular machine element as desired. The cams of the other mechanisms 2 to 5 are identified 116*a,* 118*a,* and 116*b,* 118*b,* etc.

The pumps 16*a* and 16*b* shown diagrammatically in FIG. 4 appear in FIG. 1 fully immersed in the reservoir R on opposite sides of the cam shaft with their cylinders 18*a* disposed in horizontal alignment. The pistons 20*a* and 20*b* are rigidly connected to opposite ends of the yoke 28 by suitable fasteners 123. The yoke has an offset mid-portion to bridge across the cam shaft in the space between the cams 116 and 118. The yoke also has cam roller followers 125 and 126. The roller follower 125 is on one side of the yoke in the plane of the cam 116 to ride on the cam lobe 122. The roller follower 126 is on the opposite side of the yoke in the plane of the cam 118 to ride upon the cam lobe 124.

The valve mechanisms 26*a* and 26*b* shown diagrammatically in FIG. 4 appear in FIG. 1 fully immersed in the reservoir R and have valve bodies 131 mounted to the tank cover 114 by brackets 132. Each valve body is split, that is composed of two separable sections 131' and 131'', so that the internal parts of the valve may be assembled. The cylinders 18*a* and 18*b* of the pumps 16*a* and 16*b* are open ended cylinders attached to the valve bodies in a manner such that the valve bodies act as cylinder heads. The space in each pump cylinder 16*a,* 16*b* between its piston and cylinder head provides a variable volume space into which hydraulic fluid is drawn from the reservoir R and then expelled under pressure.

The fittings 140, 142 on the valve body of valve mechanism 26*a* and the fittings 144 and 146 on the valve body of the valve mechanism 26*b* are provided for the opposite ends of the pilot pressure lines 36*a* and 36*b.*

The valve mechanisms 26*a* and 26*b* are identical and therefore only one, the valve mechanism 26*b* shown in FIG. 3, will be described in detail.

The three valves 30*b,* 34*b* and 40*b* of valve mechanism 26*b* are disposed in the valve body 131. The valve 34*b* is a poppet type check valve which consists of an axially movable piston rod 150 having a conical head 152 operative to close a conical inlet opening 154 to the chamber 156 of valve body 131. Intermediate its ends, this piston rod has a collar 157. A calibrated compression coil spring 158*b* bearing against an internal shoulder of the valve body and against the collar 157 normally urges the valve 34*b* to the right causing the piston head 152 to seat and close the opening port 155 to reservoir R. Collar 157 is generally square in shape, its rounded corners engaging the face of valve body section 131' to provide an end stop when the valve is opened by pilot pressure. It will be noted that the pressure line 24*b* to the upper end of the motor cylinder 10 opens into this chamber 156. Hydraulic fluid is allowed to flow from the chamber 156 to the reservoir R when the valve is open.

A pilot piston 160 on the end of the rod 150 opposite the piston head reciprocates in a cylindrical extension 161 of chamber 156. This chamber extension 161 is in communication with pilot pressure line 36*a* via passage 162. The valve 34*b* is caused to open in response to a build up of pressure in the pilot pressure line 36*a* acting on pilot piston 160. The valve 34*b* is also caused to open by an increase in pressure in the chamber 156 over safe operating limits.

Valve 30*b* is a poppet type check valve and comprises a rod 168 axially reciprocable in chamber 166 having a conical head 170 adapted to close against a conical seat 172 around the passage 174 connecting chamber 166 with the cylinder of pump 18*b.* The opposite end of the rod 168 is guided for reciprocation in a narrow chamber extension, and a compression coil spring 171*b* bearing against a chamber end wall and the piston head 170 normally holds the valve closed. Chamber 166 communicates with chamber 156 through a port 176. The valve 30*a* acts as a check valve to prevent fluid from flowing from the pressure line 24*b* backwards into the pump cylinder when the pump piston is drawing fluid into the pump from the reservoir.

The valve 40*b* is a pilot operated, spring loaded suction intake check valve of the poppet type adapted to admit hydraulic fluid to the pump cylinder from the reservoir R and through the intake passage 38*b.* This valve has an axially reciprocable piston rod 180 provided with a conical piston head 182 on one end adapted to close against the conical seat 184 surrounding the port 179 from the pump cylinder to the chamber 186 in which the valve operates. The valve 40*b* is normally held closed by the compression coil spring 188*b* compressed between a shoulder in the chamber 186 and a collar 190 on the rod. Collar 190 may be generally square in shape, like collar 157, and have rounded corners engaging the face of valve section 131' to provide an end stop when the valve is opened by pilot pressure. A pilot piston 192 on the opposite end of the rod operates in a cylindrical extension 194 of chamber 186. The chamber extension 194 is in communication with the pilot pressure line extension 193.

Figure 2A:
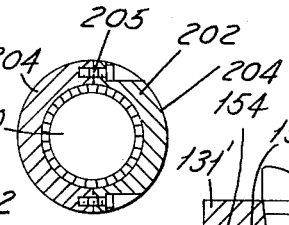
FIG. 2A is a sectional view taken on the line 2A—2A in FIG. 2.

The cams 116 and 118 of mechanism 1, as well as the two cams of each of the other mechanisms, are separated by spacer sleeves 200. The pairs of cams of mechanisms 2–5 are separated by split spacers 202. As seen in FIG. 2A, each split spacer 202 comprises two half sections 204 removably secured together about the cam shaft by fasteners 205. The portion of the shaft surrounded by each split spacer has an unsplined reduced neck 207 so that when the spacer is removed the adjacent cam of either mechanism on opposite sides thereof may be moved axially over the neck, rotated, and returned to an adjusted operative position. The bearing 110 is mounted in a split housing made of half sections similar to those shown in FIG. 2A so that it may be removed to permit cam 118 of mechanism 1 to be adjusted in the neck surrounded by the bearing when cover 114 and cam assembly are removed and inverted. Cam 116 is adjusted by removing nut 109 and sprocket wheel 108 and sliding the cam off the end of the shaft.

Referring to FIG. 1, the cam lobes 122 and 124 are seen to be identically contoured although 90° out of phase. The arcuate portion increases gradually in radius from both sides up to the high point 250. FIG. 1 shows roller 126 engaging the high point of cam lobe 124 while roller 125 engages a point on the cam lobe 122, 90° from the high point. During counterclockwise rotation from the position illustrated, roller 126 traverses a falling portion of the cam lobe 124 as roller 125 traverses a rising portion of cam lobe 122 moving yoke 28 to the left. The cam lobe contours are such that both rollers are in contact with their cam lobes for 90° of rotation from the position shown. Thereafter for abour 270° of cam shaft rotation the rollers 125, 126 are substantially out of contact with the cam lobes until the point 251 on lobe 124 reaches roller 126 to start moving yoke 28 back to the right. At the start of such rightward movement the flat 252 opposite the cam lobe 122 is facing roller 125.

When the cam shaft is initially turned counterclockwise from the FIG. 1 position, pressure fluid in the cylinder of pump 16*a* opens check valve 30*a* in valve body 131 and passes via pressure line 24*a* to the lower end of motor cylinder 12. It being understood that the valve mechanism 26*a* is the same as valve mechanism 26*b* shown in FIG. 3, and that their valve bodies are the same, hydraulic fluid upon opening valve 30*a* will pass through chamber 166, port 176 and chamber 156 of valve body 131 to pressure line 24*a.* Spring 158*a* is strong enough to keep valve 34*a* closed against normal working pressure. However, if a rise in pressure above normal occurs, the spring 158*a* will collapse and vent the excessive pressure to the reservoir through port 155 until such time as there is a return to normal pressure. The pilot piston 160 of valve 34*a* of valve mechanism 26*a* does not function when there is pressure in line 24*a* because this pilot piston is connected to the pilot pressure line from the other valve mechanism 26*b* which is not producing pressures at this time. Only one valve mechanism is under pressure at a time and only when the cam-operated yoke is actually moving.

When the yoke stops moving, pressure in both valve bodies 131 drops to zero and both discharge valves 34*a* and 34*b* are closed. Motor cylinder 10 is locked hydraulically and cannot be moved unless sufficient external force is applied to force open one of the valves 34*a* or 34*b.* Because the motor cylinder is locked when the yoke is not moving, it is not necessary to have continuous contact between the cams and the roller followers.

During the time that pump 16*a* is on its pressure stroke pump 16*b* is on its suction stroke. Pilot pressure in line 36*a* from pump 16*a* acts on pilot piston 160 to open discharge valve 34*b* and allow fluid returning from the top of motor cylinder 10 to return to the reservoir through valve body chamber 156 and port 155. If the cam lobe 122 calls for decelerating motion of the piston of pump 16*a,* then the volume of fluid supplied thereby is diminished and there is a drop in pressure in pilot pressure line 36*a.* This causes the discharge valve 34*b* to move in a closing direction to throttle down the discharge from the motor cylinder 10 so as to reduce the velocity of motion in conformity with the cam contours. As a result the motor cylinder more closely follows the cam contour and the problem of cavitation is reduced.

The same pilot pressure which opens discharge valve 34*b* of valve 26*b* also opens the suction intake valve 40*b.* Such pilot pressure acts on piston 192 of the valve 40*b* to refill the pump 16*b* on its suction stroke. The pilot is used to open the valve 40*b* immediately and assure complete filling during high speed operation. This also reduces the problems of entrapped air and cavitation.

Figure 5:
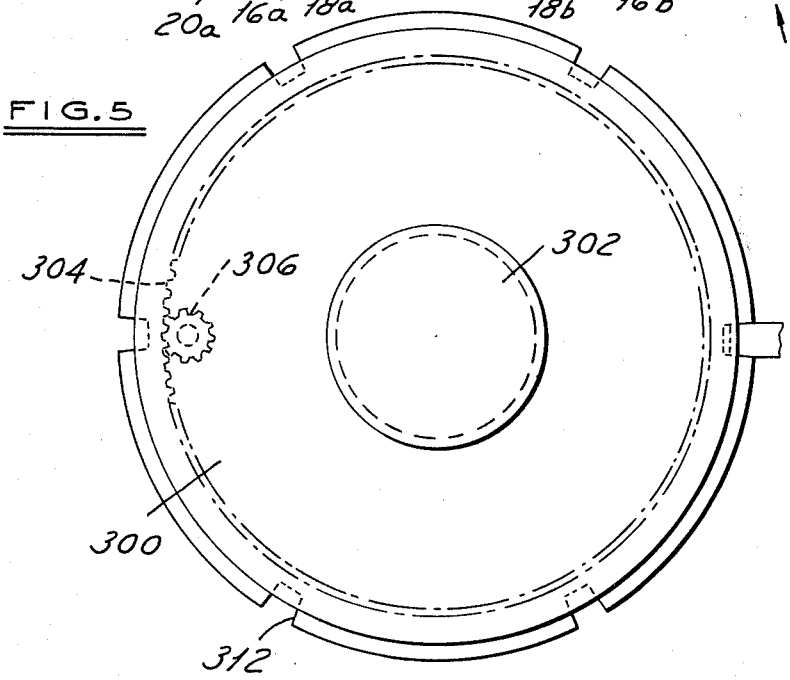
FIG. 5 is a plan view of an index table.
Figure 6:
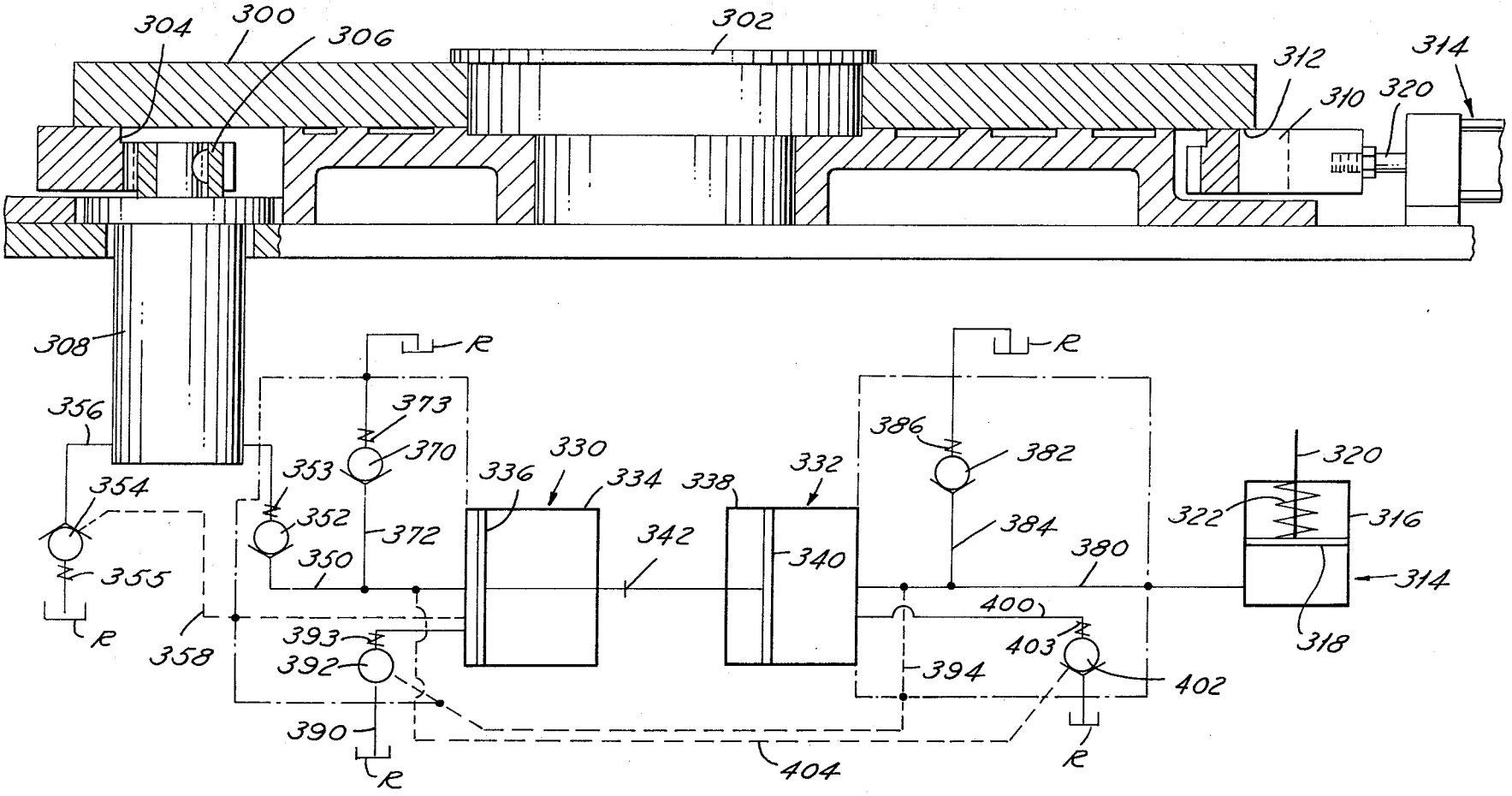
FIG. 6 is an enlarged sectional view of the index table and includes a hydraulic diagram of a device for controlling the movement of the table.

FIGS. 5 and 6 illustrate an index table 300 and related hydraulic circuit diagram. In this embodiment, the rotary index table can be driven and controlled by a pair of cam lobes which are not shown but which may be similar to the cam lobes 116 and 118 previously described. The index table 300 has a center pin 302 on which it rotates. An internal ring gear 304 is mounted to the underside of the table in concentric relation to the pivot pin. An external drive gear 306 is engaged with the ring gear 304. The drive gear is driven by suitable hydraulic means, in this instance the rotary hydraulic motor 308.

A locator pin 310 is engageable with any one of the slots 312 around the periphery of the index table to lock the table in indexed position. The locator pin is operated by the single-acting piston cylinder motor assembly 314. The motor assembly 314 includes the cylinder 316 and piston 318 reciprocable therein. The locator pin 310 is connected to the rod 320 of the piston. As stated, the motor assembly 314 is single-acting and has a return spring 322.

The hydraulic drive and control mechanism includes the piston pumps 330 and 332. Pump 330 has a cylinder 334 and a piston 336 reciprocable therein. Pump 332 has a cylinder 338 and a piston 340 reciprocable therein. The pistons 336 and 340 of the two pumps are mechanically linked together by a yoke 342 which constrains the pistons to move as a unit. As in the previous embodiment, the pumps are disposed horizontally on opposite sides of a cam shaft (not shown) similar to the one previously described and are controlled in their to and fro movements by cams similar to the cams 116 and 118 mounted on the cam shaft and appropriately contoured to carry out the function of indexing and locking the table in indexed position.

The pump 330 has a pressure line 350 which extends to one side of the rotary motor 308 through a check valve 352. The check valve 352 permits flow in a direction from the pump to the motor 308 but prevents reverse flow. This valve is normally closed under a light pressure of spring 353 but opens in response to the build up of pressure upon movement of the piston 336 on its pressure stroke to supply hydraulic fluid to one side of the motor 308 and through the gears 304 and 306 to turn the index table.

To prevent the motor 308 from overrunning the cam contour during deceleration a pilot operated discharge valve 354 is provided in the exhaust line 356 which extends from the opposite side of the motor to the unpressurized reservoir R. This valve 354 is a check valve which permits flow in a direction from the motor to the reservoir but prevents reverse flow. It is normally closed by pressure of spring 355. It is forced open by pilot pressure in the pilot pressure line 358 which leads from the cylinder chamber of pump 330. Thus when the piston 336 is on its pressure stroke pilot pressure in line 358 is sufficient to open the check valve 354 against its spring. This permits fluid to be discharged from the exhaust side of the motor. Upon deceleration of the piston 336 and consequent reduction in pressure in the pilot line 358, the valve 354 will be moved in a closing direction by its spring and thus throttle the exhaust of fluid from the motor.

An overload check valve 370 is provided in the line 372 from the pressure line 350 to the unpressurized reservoir line R. This valve 370 is a check valve which permits flow in a direction from the pump toward the reservoir but prevents reverse flow. It is normally held closed by a calibrated spring 373 which has sufficient strength to prevent the valve from opening under normal operating pressure conditions but which will collapse and allow the valve to open when an excessive pressure is reached.

The pump 332 has a pressure line 380 which extends from the pump chamber to the cylinder 316 of the single-acting motor cylinder 314. When the piston 340 moves to the right or on its pressure stroke, the motor piston 318 is advanced to move the locator pin 310 toward the index table for engagement in one of the index slots 312. An overload valve 382 is provided in the line 384 which extends from pressure line 380 to the unpressurized reservoir R. This valve is a check valve which permits flow toward the reservoir but prevents reverse flow. It is normally held closed by a calibrated spring 386 which has sufficient strength to hold the valve closed under conditions of normal operating pressure but will collapse and open if the pressure becomes excessive.

Referring again to the pump 330, a suction intake line 390 extends from the unpressurized reservoir R to the pump chamber through a check valve 392 which permits flow from the reservoir to the pump but prevents reverse flow. This valve is normally held closed under light pressure by spring 393. It is a pilot operated valve and is opened by pressure in the pilot pressure line 394 from the cylinder of pump 332. Thus when the piston of pump 330 is on its suction stroke, and the piston 332 consequently is in its pressure stroke, pressure in the pilot pressure line 394 will immediately open the valve 392 to admit fresh fluid into the chamber of pump 330.

The pump 332 also has a suction intake line 400 normally closed by a check valve 402 which permits flow from the unpressurized reservoir R to the pump but prevents reverse flow. This valve is lightly held closed by pressure of spring 403 but is opened by pressure in the pilot pressure line 404 which extends from the pressure line 350 of pump 330. Thus when the pump 332 is on its suction stroke, and pump 330 is consequently on its pressure stroke, the valve 402 in the suction intake line 400 is immediately opened to supply fresh fluid to the cylinder of pump 332.

Thus, in operation, when the pump pistons 336 and 340 are moved to the left, that is on the pressure stroke of the pump 330, the motor 308 is driven to rotate the index table. Pilot pressure from the pump 330 immediately opens the valve 354 in the discharge line 356 to permit the exhaust of fluid from the exhaust side of the motor. At the same time, pilot pressure from the pump 330 opens the suction intake valve of the pump 332 to allow fresh fluid to enter pump 332 on its suction stroke. At this time, the locator pin 310 is retracted by the spring 322 in the motor 314.

Then upon the reversal of the pistons 336 and 340, during which time the piston of pump 330 is on its suction stroke, fresh fluid will be drawn into pump 330 through line 390, the check valve 392 being immediately opened by pilot pressure in line 394 from pump 332. Check valves 352 and 354 will close by pressure of their springs to hydraulically lock the motor 308 against turning. Pressure in the line 380 from pump 332 will advance the piston 318 to move the locator pin 310 into one of the indexing slots of the table to lock it in position.

Figure 7:
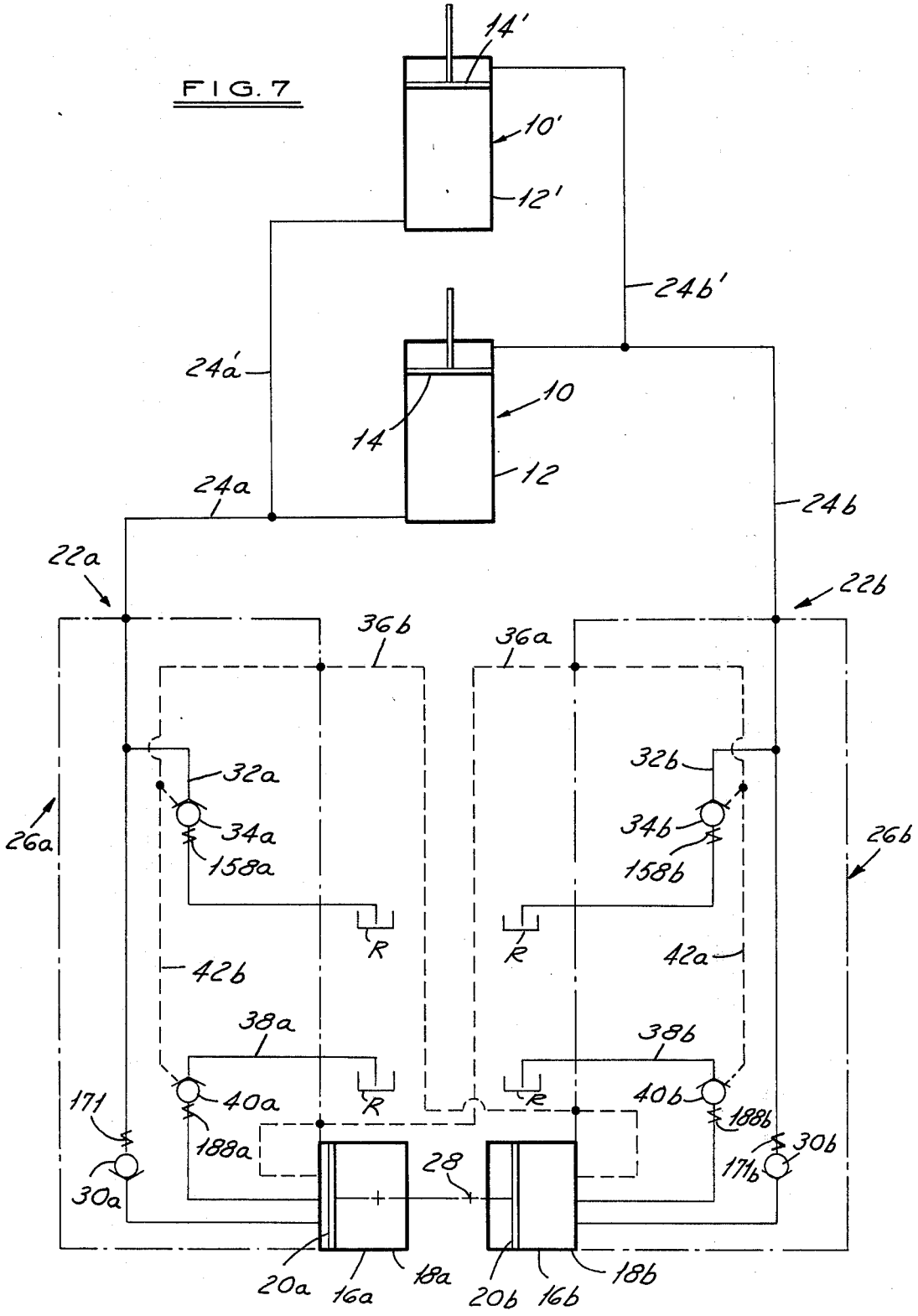
FIG. 7 is a hydraulic diagram showing a modification of the invention.

FIG. 7 shows diagrammatically an operating and control mechanism which is like that of FIG. 4 with the addition of a second double-acting hydraulic piston cylinder motor assembly 10' having a piston 14' acting in a cylinder 12'. The piston of motor assembly 10' may be considered as being connected to a mechanical device such, for example, as a machine element on a machine tool which is moved back and forth by the piston, similarly to the operation of motor assembly 10. The motor assembly 10' is shown as being connected in parallel with motor assembly 10 by hydraulic lines **24*a'* and 24*b'*.**

Figure 8:
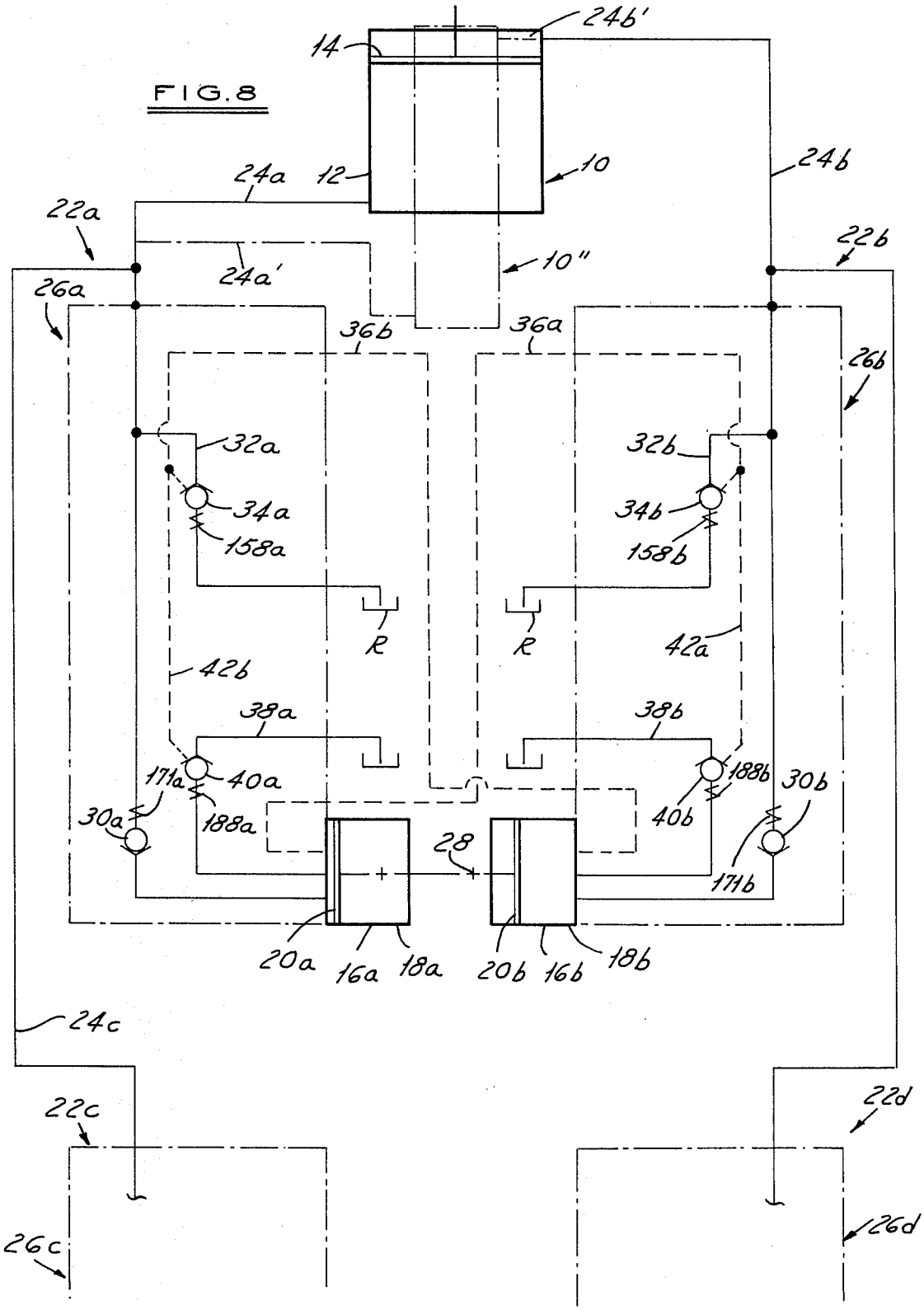
FIG. 8 is a hydraulic diagram showing a further modification.

FIG. 8 shows diagrammatically an operating and control mechanism which is like that of FIG. 4 with the addition of second and third hydraulic systems **22*c* and 22*d* each having all of the components, including pumps and valve assemblies etc., of the respective hydraulic systems 22*a* and 22*b* which are of the same construction and interrelated in the same way. The valve assemblies of the two systems 22*c* and 22*d* are indicated at 26*c* and 26*d*. The pressure line 24*c* of system 22*c* connects into pressure line 24*a* of system 22*a*, and pressure line 24*d* of system 22*d* connects into pressure line 24*b* of system 22*b*. Hence the power and volume of systems 22*a* and 22*c* and of systems 22*b* and 22*d* are added together to operate the motor assembly. FIG. 8 also shows the motor assembly 10** elongated in phantom lines to extend the stroke of the piston. The foreshortened motor assembly in solid lines has a shorter stroke but greater power.

What I claim as my invention is:

1. Means for imparting alternating motion to a hydraulic motor assembly comprising a first hydraulic system for driving said motor assembly in one direction and a second hydraulic system for driving said motor assembly in the opposite direction, a reservoir for hydraulic fluid, each system having a pump assembly, each system having a suction line from said reservoir to its pump assembly, each system having a hydraulic pressure line from its pump assembly to said motor assembly, each system having a discharge line from said motor assembly to said reservoir, the pressure and discharge lines of one system communicating with one side of said motor assembly and the pressure and discharge lines of the other system communicating with the other side thereof, means for operating said pump assemblies alternately to deliver pressure fluid to one side of said motor assembly and then to the other side thereof to drive said motor assembly in opposite directions, a valve in each suction line permitting flow only in a direction away from said reservoir, a normally closed valve in each discharge line, and means responsive to the build up of pressure in the pump assembly of each system for opening the valve in the discharge line of the other system.

2. The structure defined in claim 1, wherein said pump assemblies are of the piston-cylinder type, and means for moving the pistons of said pump assemblies simultaneously so that one is on its pressure stroke while the other is on its suction stroke and vice versa.

3. Means for imparting reciprocatory motion to the piston of a double-acting hydraulic piston-cylinder motor assembly comprising a first hydraulic system for moving said piston in one direction and a second hydraulic system for moving said piston in the opposite direction, a reservoir for the hydraulic fluid, each system having a piston-cylinder pump assembly, each system having a suction line from said reservoir to the cylinder of its pump assembly, each system having a hydraulic pressure line from the cylinder of its pump assembly to said motor assembly, each system having a discharge line from said motor assembly to said reservoir, the pressure and discharge lines of one system communicating with one end of the cylinder of said motor assembly and the pressure and discharge lines of the other system communicating with the other end thereof, cam means for moving the pistons of said pump assemblies simultaneously in opposite directions so that one is on its pressure stroke while the other is on its suction stroke and vice versa, a check valve in each suction line permitting flow only in a direction away from said reservoir, a normally closed valve in each discharge line, and means responsive to the build up of pressure in the pump assembly of each system for opening the valve in the discharge line of the other system.

4. The structure defined in claim 3, wherein the normally closed valve in each discharge line is adapted to open in response to excessive pressure in the end of the cylinder of said motor assembly with which said discharge line is in communication to provide overload protection.

5. The structure defined in claim 4, wherein the valve in each discharge line is held normally closed by a calibrated spring.

6. The structure defined in claim 3, including a check valve in each pressure line permitting flow only in a direction toward said motor assembly.

7. The structure defined in claim 3, wherein said means for opening the valves in said discharge lines comprises a pilot pressure line from the pump assembly of each system to the valve in the discharge line of the other system.

8. The structure defined in claim 3, including means responsive to the build up of pressure in the pump assembly of each system for opening the valve in the suction line of the other system.

9. The structure defined in claim 8, wherein said means for opening the valves in said suction lines comprises a pilot pressure line from the pump assembly of each system to the valve in the suction line of the other system.

10. The structure defined in claim 6, including means responsive to the build up of pressure in the pump assembly of each system for opening the valve in the suction line of the other system, said means for opening the valves in said discharge and suction lines comprising a pilot pressure line from the pump assembly of each system to the valves in the discharge and suction lines of the other system.

11. The structure defined in claim 3, including a second motor assembly, said pressure and discharge lines of one system communicating with one side of said second motor assembly and said pressure and discharge lines of the other system communicating with the other side of said second motor assembly.

12. The structure defined in claim 3, including a second means for imparting reciprocatory motion to the piston of said motor assembly including third and fourth hydraulic systems having the construction and having the same relationship to said motor assembly as the first and second systems respectively.

13. Means for intermittently driving a hydraulic motor comprising a first piston-cylinder pump assembly, a hydraulic pressure line from the cylinder of said first pump assembly to one side of said motor, a discharge line from the opposite side of said motor, a valve normally closing said discharge line, said first pump assembly being operative to deliver fluid under pressure to said motor through said hydraulic pressure line on the advance of said piston, means operated simultaneously with the advance of said piston to open said valve, a hydraulic reservoir, a suction intake line from said reservoir to said cylinder, a check valve in said suction intake line permitting flow only in a direction toward said cylinder, a second piston-cylinder pump assembly, a hydraulic pressure line from the cylinder of said second pump assembly to a mechanism operated thereby, cam means operative to advance the piston of one pump assembly while retracting the piston of the other pump assembly and vice versa intermittently to deliver fluid under pressure from said first pump assembly to said one side of said motor to drive the same and to deliver fluid under pressure from said second pump assembly to said mechanism, and a pilot pressure line from the cylinder of said second pump assembly to said check valve to open the latter in response to a pressure buildup occasioned by the advance of the piston thereof.

14. Means for intermittently driving a hydraulic motor comprising a first pump assembly, a hydraulic pressure line from said first pump assembly to said motor, a hydraulic intake line to said first pump assembly, a check valve in said intake line permitting flow only in a direction toward said first pump assembly, a second pump assembly, a hydraulic pressure line from said second pump assembly to a mechanism operated thereby, means for operating said pump assemblies alternately to deliver fluid under pressure from said first pump assembly to said motor to drive the same and to deliver fluid under pressure from said second pump assembly to said mechanism, and a pilot pressure line from said second pump assembly to said check valve to open the latter in response to the buildup of pressure in said second pump assembly.

15. The structure set forth in claim 14, including a discharge line from said motor, a valve normally closing said discharge line, and means responsive to the buildup of pressure in said first pump assembly for opening said last-mentioned valve.

16. The structure defined in claim 13, including a second suction intake line from said reservoir to the cylinder of said second pump assembly, a second check valve in said second suction intake line permitting flow only in a direction away from said reservoir, and a pilot pressure line from the cylinder of said first pump assembly to said second check valve to open the latter in response to a build up of pressure occasioned by the advance of the piston in said first pump assembly.

17. The structure defined in claim 16, wherein said motor is connected to a turntable to index the same, and the mechanism operated by said second pump assembly is a pin to stop said turntable in indexed position.

* * * * *